US006098593A

United States Patent [19]

Aschner

[11] Patent Number: 6,098,593

[45] Date of Patent: Aug. 8, 2000

[54] ELECTRONIC BUCKING DAMPING DEVICE FOR INTERNAL-COMBUSTION ENGINES

[75] Inventor: Werner Aschner, Ulm, Germany

[73] Assignee: DaimlerChrysler AG, Stuttgart, Germany

[21] Appl. No.: 09/084,870

[22] Filed: May 28, 1998

[30] Foreign Application Priority Data

May 28, 1997 [DE] Germany ..... 197 22 253

[51] Int. Cl.[7] ..... F02D 31/00

[52] U.S. Cl. ..... 123/357; 123/436; 123/406.24

[58] Field of Search ..... 123/406.24, 406.25, 123/436, 352, 357

[56] References Cited

U.S. PATENT DOCUMENTS

| | | | |
|---|---|---|---|
| 4,359,991 | 11/1982 | Stumpp et al. | 123/478 |
| 4,656,986 | 4/1987 | Kull et al. | 123/357 |
| 4,690,114 | 9/1987 | Weischedel | 123/357 |
| 4,924,835 | 5/1990 | Denz | 123/478 |
| 4,928,652 | 5/1990 | Shinya et al. | 123/417 |
| 4,993,398 | 2/1991 | Ahlborn et al. | 123/436 |

FOREIGN PATENT DOCUMENTS

| | | |
|---|---|---|
| 0 768 455 | 4/1997 | European Pat. Off. . |
| 33 43 854 | 6/1985 | Germany . |
| 36 34 551 | 4/1988 | Germany . |
| WO 89/07709 | 8/1989 | WIPO . |

OTHER PUBLICATIONS

Automatisierungstechnik 43 (1995) entitled "Kennfelder in der Regelungstechnik", pp. 363–367.

*Primary Examiner*—Henry C. Yuen
*Assistant Examiner*—Arnold Castro
*Attorney, Agent, or Firm*—Evenson, McKeown, Edwards & Lenahan, PLLC

[57] ABSTRACT

An electronic bucking damping device is provided for internal-combustion engines with an electronic fuel injection in motor vehicles, particular for diesel engines. By way of an accelerator pedal, a quantity request signal is given and is fed by way of a PDT1-filter to a summation point connected with the control signal input of the fuel injection device. A rotational speed signal is filtered by way of a D2T2-filter and is subtracted in the summation point from the filtered quantity request signal. Via the filtered quantity request signal, load jumps and a related uncomfortable vehicle handling are avoided, and via the inverse coupling of the bucking vibration superimposed on the rotational speed signal, the bucking is damped or prevented. Using the two separate filters, the quantity damping and bucking damping functions are uncoupled, which simplifies the application.

17 Claims, 2 Drawing Sheets

ELECTRONIC BUCKING DAMPING DEVICE FOR INTERNAL-COMBUSTION ENGINES

BACKGROUND AND SUMMARY OF THE INVENTION

This application claims the priority of German Application No. 197 22 253.6, filed May 28, 1997, the disclosure of which is expressly incorporated by reference herein.

The invention relates to an electronic bucking damping device for internal-combustion engines with an electronic fuel injection in motor vehicles, particularly diesel engines, having a quantity request signal which can be defined by an accelerator pedal and is fed to a fuel injection device, and having a quantity component signal which is derived from the bucking vibration superimposed on the rotational speed signal of the internal-combustion engine and is supplied in an inverse-coupled manner to the fuel injection device.

In order to avoid load jumps and a related uncomfortable vehicle handling in the case of motor vehicles with electronic fuel injection, the quantity request signal definable by way of the accelerator pedal must be filtered in a suitable manner. However, despite the filtering of the quantity request signal, vibration-type excitations of the transmission line are possible. This results in a so-called "bucking" vehicle handling. This bucking can be damped in a known manner in that the bucking vibration superimposed on the rotational speed signal is inversely-coupled to the injection quantity signal by way of a filter arrangement.

The known filter arrangements used for this purpose are relatively complex and have a relatively confusing construction because of the couplings and inverse couplings and are therefore difficult to apply.

It is an object of the present invention to provide an effective and comfortable bucking damping device which is easy to apply.

According to the invention, this object is achieved in that the quantity request signal is present by way of a filter with proportional (P), differentiating (D), and time delay (T) functions of the first (1) order PDT1-filter at a summation point connected with the control signal input of the fuel injection device, and the rotational speed signal filtered by way of a separate filter with differentiating (D) function of the second (2) order and a delay function (T) of the second (2) order D2T2-filter is present at this summation point as the quantity component signal to be subtracted.

According to the invention, the quantity damping and bucking damping functions were uncoupled by the two separate filters so that they can be adjusted and optimized independently of one another, whereby the desired simplified application is achieved. The filter functions are simpler and easier to understand and optimize. A PDT1-filter was found to be most suitable for the quantity damping and a D2T2-filter was found to be must suitable for the bucking damping.

The measures indicated herein permit advantageous further developments and improvements of the bucking damping device according to the present invention.

In the case of a vehicle, the amplitude and the frequency of the bucking vibrations are very dependent on the operating point, in which case the significant influencing quantities are the respective existing gear position and the rotational engine speed. Advantageously, for defining at least one portion of the filter parameters for the characteristic filter diagrams, characteristic diagrams are provided for the filters, in which case the filter parameters by way of these characteristic diagrams can be defined at least as a function of the rotational speed of the internal-combustion engine and/or of the respective existing gear position of the transmission in order to achieve, in all operating conditions, a respective optimal damping of the bucking.

It was also found to be advantageous to provide at least one switch-over device for changing over between a characteristic-diagram-dependent defining of filter parameters and a defining of fixed filter parameters, in which case a change-over of the change-over devices to the fixed filter parameters is provided in the case of external quantity interventions which require a fast reaction of the fuel injection device, and in which case the fixed filter parameters reduce or eliminate the filtering effect of the filters. As a result, it is, for example, ensured that, in the event of a start of an anti-slip control device (ASR), the internal-combustion engine will react in an undelayed manner.

As an alternative, it is also possible to provide that one filter or both filters can be bridged by a switching device in the case of external engine interventions which require a fast reaction of the fuel injection device. This also prevents the delay of the quantity request by filters if certain fast quantity interventions are required.

The bucking damping device according to the invention is mainly suitable for diesel engines with an electronically controlled injection pump.

Other objects, advantages and novel features of the present invention will become apparent from the following detailed description of the invention when considered in conjunction with the accompanying drawings.

DETAILED DESCRIPTION OF THE DRAWINGS

Figure 1:
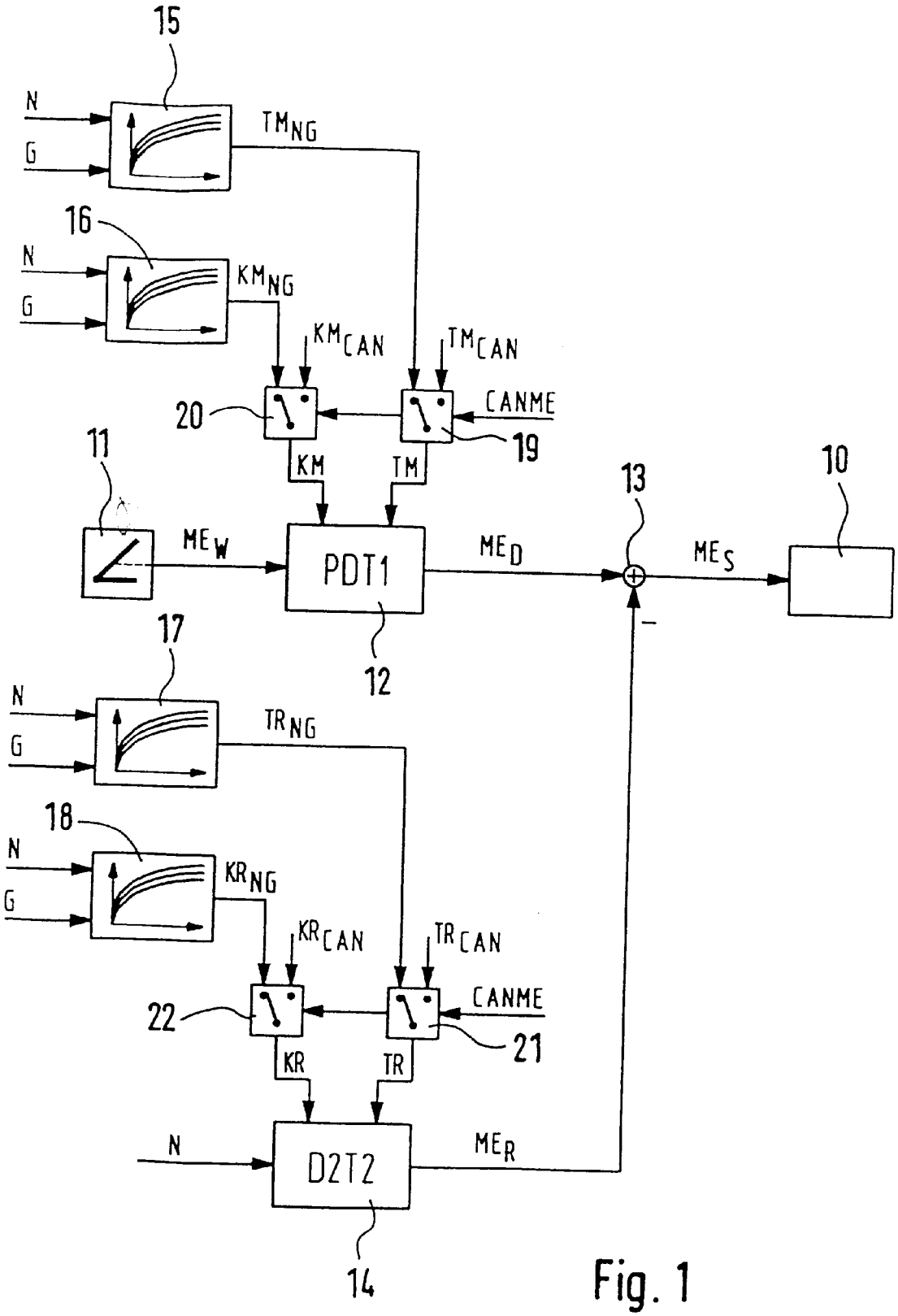
FIG. 1 is a block diagram of an electronic bucking damping device as an embodiment of the invention.

The embodiment illustrated in FIG. 1 shows an electronic bucking damping device for diesel engines with an electronically controlled injection pump 10. However, the invention is also suitable for diesel engines with a different electronic fuel injection device as well as generally for internal-combustion engines, thus, for example, for Otto engines, with an electronic fuel injection. The injection pump 10 will then be replaced by the respectively provided fuel injection system.

The quantity request signal $Me_W$ generated by an accelerator pedal 11 is fed by way of a PDT1-filter 12 and by way of a summation point 13 arranged behind the PDT1-filter to the injection pump 10 as the control signal. In the summation point 13, a rotational speed signal N is inversely coupled, which is filtered by way of a D2T2-filter 14 and is received from a rotational speed generator, which is not shown, at the diesel engine. This means that the rotational speed signal filtered in the D2T2-filter 14 is subtracted as the quantity component $Me_R$ generated by the bucking vibrations from the filtered quantity request signal $Me_D$ at the output of the PDT1-filter 12. The difference results in the summed-up quantity signal $Me_S$ which is fed to the injection pump 10 as the effective quantity control signal.

For the purpose of a simplification, otherwise customary components of the injection quantity calculation were not shown, such as the idling control device and quantity limiting devices.

A PDT1-filter has the following transmission function:

$$\frac{Me_D(p)}{Me_W(p)} = k_M + \frac{(1-k_M)}{1+p*T_M} = \frac{1+p*T_M*k_M}{1+p*T_M}$$

Figure 2:
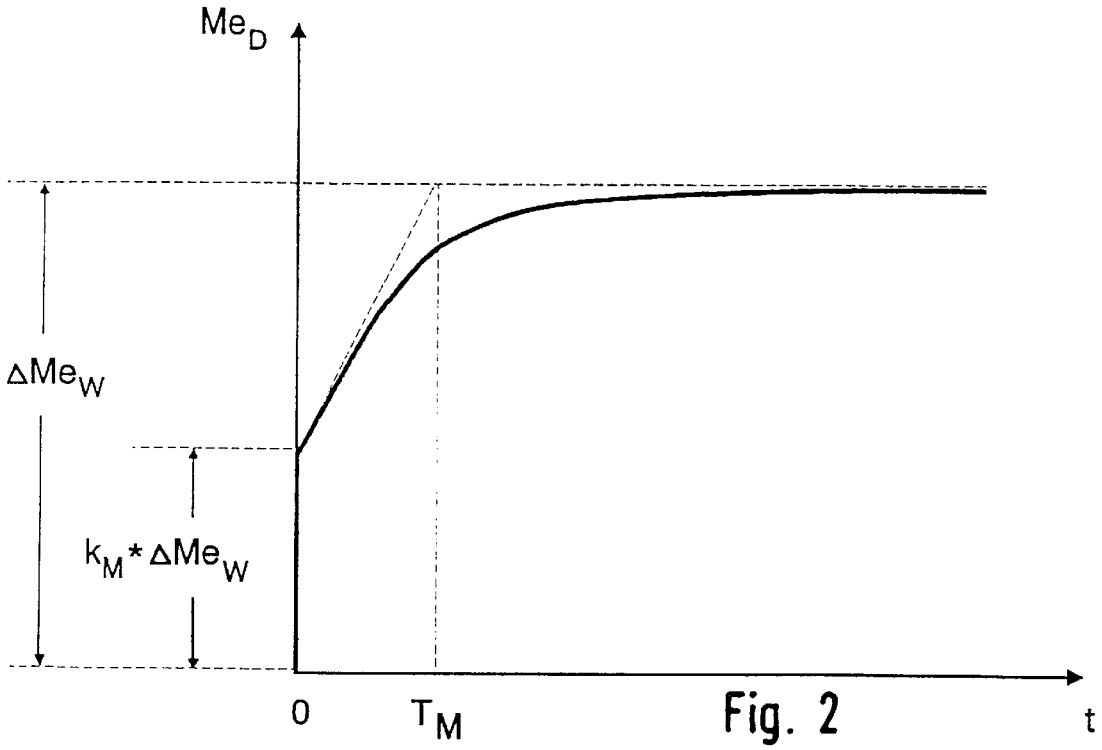
FIG. 2 is a view of a signal diagram for explaining the method of operation of the PDT1-filter.

In this case, according to FIG. 2, $k_M$ is the jump constant, and $T_M$ is the time constant of the transmission function or of the PDT1-filter 12. p is the complex frequency variable normally used in the case of transmission functions. As the reaction to a quantity request signal $Me_W$, the damped quantity course $Me_D$ illustrated in FIG. 2 is therefore obtained which is composed of two partial components, specifically a jump-type part, which is determined by the jump constant $k_M$, and an e-function which is characterized by the time constant $T_M$. By means of the filtering of the quantity request signal, load jumps and a related uncomfortable vehicle handling can be avoided.

Figure 3:
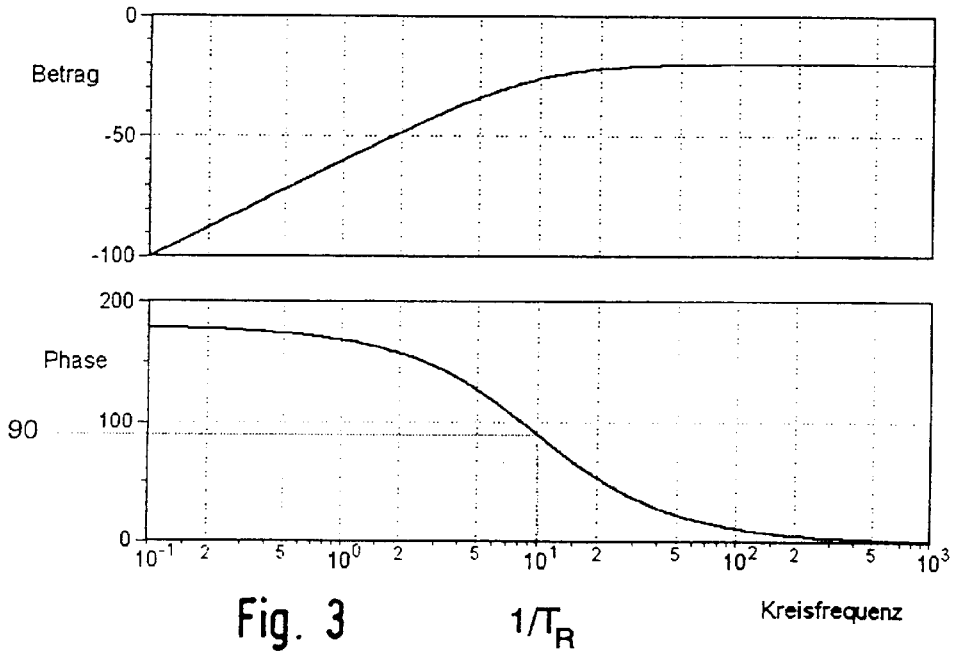
FIG. 3 is a view of a Bode's diagram for explaining the method of operation of the D2T2-filter.

The transmission function of the D2T2 filter 14 is illustrated in FIG. 3 in the form of a Bode's diagram. Such a D2T2-filter has the following transmission function:

$$\frac{Me_R(p)}{N(p)} = \frac{p^2*k_R}{(1+p*T_R)^2}$$

In this case, $k_R$ is the amplification factor and $T_R$ is the time constant of the D2T2-filter 14 used as the bucking damper. Despite the filtering of the quantity request signal $Me_W$, vibration-type excitations of the transmission line of the diesel engine or of another internal-combustion engine are possible which lead to a bucking vehicle handling. By means of the D2T2-filtering of the rotational speed signal N, a quantity component $Me_R$ is obtained which dampens the bucking and which is subtracted in the manner described above from the filtered quantity request signal $Me_D$ in order to obtain the summed-up or actual quantity signal $Me_S$.

Since, in the case of motor vehicles, the amplitude and the frequency of the bucking vibrations are very dependent on the operating point, fixed filter constants will have unsatisfactory results at least in partial ranges. Important quantities affecting the bucking vibrations are the respective existing gear position G of the vehicle transmission and the rotational speed N of the engine. The four filter constants for the two filters 12, 14 are therefore defined as a function of th(e gear position G and of the rotational engine speed N by way of characteristic diagrams 15 to 18. The determination of the characteristic diagram values essentially takes place by computer simulation. Subsequently, empirical corrections will then still be carried out during driving tests. In conjunction with FIG. 3, the filter constants $T_M$, $k_M$, $T_R$ and $k_R$ will in the following also be called TM, KM, TR and KR.

The four filter parameters, which can be determined by the characteristic diagrams 15 to 18, are applied by way of and switch-over steps 19 to 22 to inputs of the filters 12 and 13, by way of which the filter parameters can be defined. The indicated switching positions of the switch-over steps 19 to 22 are the switching positions for the normal driving operation, in which the filter parameters $TM_{NG}$, $KM_{NG}$, $TR_{NG}$ and $KR_{NG}$ of the characteristic diagrams 15 to 18, which depend on the influence quantities G and N, are present at the filter inputs of the filters 12 and 14 which determine the filter parameters. In the event of external quantity interventions, which require a very fast load reaction of the diesel engine or of another internal-combustion engine, as, for example, in the event, of an anti-slip control device (ASR) or certain transmission control interventions, a signal CANME is fed to the switch-over steps 19, 22, for example, from a central engine timing control or from the individual control components, which signal in each case causes a switching-over into the other switching condition. In this other switching state, fixed filter parameter values $TM_{CAN}$, $KM_{CAN}$, $TR_{CAN}$ and $KR_{CAN}$ are present at the filters by way of these switch-over steps 19 and 22. These filter constants, which are independent of influence quantities, cause a reduction of the filtering effect of these filters 12, 14 so that fast quantity signal changes can be implemented. In this case, these filter constants can also be selected such that the filters are completely ineffective. For example, generally meaningful filtering characteristics of the PDT1-filter 12 are obtained at values of the jump constants KM between 0 and 1. If KM is set to 1, there will no longer be a filtering effect.

In the case of simpler embodiments, it is naturally also possible to define the filter constants only partially by way of characteristic diagrams. Furthermore, filter constants dependent on influence quantities defined by characteristic diagrams 15 to 18 may also only partially be guided via switch-over steps 19 to 22. For example, in the case of the PDT1-filter 12, the switch-over step 19 may also be eliminated so that only a switch-over of the jump constants KM is possible which, however, will be sufficient in the individual case.

As a modification of the illustrated embodiment, the filters 12 and 14 may also have modified filtering characteristics, if, in the individual case, these are found to be sufficient or advantageous. The influence-quantity-dependent defining of filter constants by way of characteristic diagrams is also advantageous and significant in connection with other filters or with filters with other filtering characteristics.

The switch-over steps 19 to 22 can also be replaced by bridging switches for the filters 12 and 14 which can be operated by a corresponding control signal CANME; that is, when such a signal occurs, the filters 12 and/or 14 are bridged.

In the embodiment which is currently customary, the switching or switch-over functions are implemented by computer-controlled functions, which applies partially also to the remaining components.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Electronic bucking damping device for an internal-combustion engine with an electronic fuel injection, said electronic bucking damping device having a quantity request signal definable via an accelerator pedal and being fed to a fuel infection device, as well as a quantity component signal derived from bucking vibration superimposed on a rotational speed signal of the internal combustion engine and being supplied in an inverse-coupled manner to the fuel injection device, wherein said quantity request signal is present by way of a PDT1-filter at a summation point connected with a control signal input of the fuel injection device, and further wherein said rotational speed signal filtered by way of a separate D2T2-filter is present at this summation point as the quantity component signal to be subtracted;

wherein for defining at least a portion of the filter parameters for the filters, characteristic diagrams are provided; and wherein the filter parameters are defined by way of the characteristic diagrams at least as a function of the rotational speed of the internal-combustion engine and/or of the respective existing gear position of a transmission.

2. Bucking damping device according to claim 1, wherein at least one switch-over device is provided for the switch-over between a characteristic-diagram-dependent definition of filter parameters and a definition of fixed filter parameters, a switch-over of the at least one switch-over device to the fixed filter parameters being provided in the event of external quantity interventions which require a fast reaction of the fuel injection device, and the fixed filter parameters reducing or eliminating the filtering effect of the filers.

3. Bucking damping device according to claim 1, wherein one filter or both filters are bridged by a switching device in the event of external quantity interventions which require a fast reaction of the fuel injection device.

4. Bucking damping device according to claim 1, wherein the PDT1-filter has the following transmission function, $$\frac{Me_D(p)}{Me_W(p)} = k_M + \frac{(1-k_M)}{1+p*T_M} = \frac{1+p*T_M*k_M}{1+p*T_M}$$

wherein $k_M$ is the jump constant, $T_M$ is the time constant and p is the complex frequency variable.

5. Bucking damping device according to claim 1, wherein the D2T2-filter 14 has the following transmission function, $$\frac{Me_R(p)}{N(p)} = \frac{p^2*k_R}{(1+p*T_R)^2}$$

wherein $k_R$ is the amplification factor, $T_R$ is the time constant, and p is the complex frequency variable.

6. Bucking damping device according to claim 1, wherein the fuel injection device is an electronically controlled injection pump.

7. Electronic bucking damping device for an internal-combustion engine with an electronic fuel injection, said electronic bucking damping device having a quantity request signal definable via an accelerator pedal and being fed to a fuel injection device, as well as a quantity component signal derived from bucking vibration superimposed on a rotational speed signal of the internal combustion engine and being supplied in an inverse-coupled manner to the fuel injection device, wherein said quantity request signal is present by way of a PDT1-filter at a summation point connected with a control signal input of the fuel injection device, and further wherein said rotational speed signal filtered by way of a separate D2T2-filter is present at this summation point as the quantity component signal to be subtracted;

wherein for defining at least a portion of the filter parameters for the filters, characteristic diagrams are provided; and wherein at least one switch-over device is provided for the switch-over between a characteristic-diagram-dependent definition of filter parameters and a definition of fixed filter parameters, a switch-over of the at least one switch-over device to the fixed filter parameters being provided in the event of external quantity interventions which require a fast reaction of the fuel injection device, and the fixed filter parameters reducing or eliminating the filtering effect of the filters.

8. Bucking damping device according to claim 7, wherein the fuel injection device is an electronically controlled injection pump.

9. Electronic bucking damping device for an internal-combustion engine with an electronic fuel injection, said electronic bucking damping device having a quantity request signal definable via an accelerator pedal and being fed to a fuel injection device, as well as a quantity component signal derived from bucking vibration superimposed on a rotational speed signal of the internal combustion engine and being supplied in an inverse-coupled manner to the fuel injection device, wherein said quantity request signal is present by way of a PDT1-filter at a summation point connected with a control signal input of the fuel injection device, and further wherein said rotational speed signal filtered by way of a separate D2T2-filter is present at this summation point as the quantity component signal to be subtracted;

wherein for defining at least a portion of the filter parameters for the filters, characteristic diagrams are provided; and wherein one filter or both filters are bridged by a switching device in the event of external quantity interventions which require a fast reaction of the fuel injection device.

10. Bucking damping device according to claim 9, wherein the fuel injection device is an electronically controlled injection pump.

11. Electronic bucking damping device for an internal-combustion engine with an electronic fuel injection, said electronic bucking damping device having a quantity request signal definable via an accelerator pedal and being fed to a fuel injection device, as well as a quantity component signal derived from bucking vibration superimposed on a rotational speed signal of the internal combustion engine and being supplied in an inverse-coupled manner to the fuel injection device, wherein said quantity request signal is present by way of a PDT1-filter at a summation point connected with a control signal input of the fuel injection device, and further wherein said rotational speed signal filtered by way of a separate D2T2-filter is present at this summation point as the quantity component signal to be subtracted; and wherein the PDT1-filter has the following transmission function, $$\frac{Me_D(p)}{Me_W(p)} = k_M + \frac{(1-k_M)}{1+p*T_M} = \frac{1+p*T_M*k_M}{1+p*T_M}$$

wherein $k_M$ is the jump constant, $T_M$ is the time constant and p is the complex frequency variable.

12. Bucking damping device according to claim 11, wherein the fuel injection device is an electronically controlled injection pump.

13. Bucking damping device according to claim 11, wherein the D2T2-filter 14 has the following transmission function, $$\frac{Me_R(p)}{N(p)} = \frac{p^2*k_R}{(1+p*T_R)^2}$$

wherein $k_R$ is the amplification factor, $T_R$ is the time constant, and p is the complex frequency variable.

14. Electronic bucking damping device for an internal-combustion engine with an electronic fuel injection, said electronic bucking damping device having a quantity request signal definable via an accelerator pedal and being fed to a fuel injection device, as well as a quantity component signal derived from bucking vibration superimposed on a rotational speed signal of the internal combustion engine and being supplied in an inverse-coupled manner to the fuel injection device, wherein said quantity request signal is present by way of a PDT1-filter at a summation point connected with a control signal input of the fuel injection device, and further wherein said rotational speed signal filtered by way of a separate D2T2-filter is present at this summation point as the quantity component signal to be subtracted;

wherein for defining at least a portion of the filter parameters for the filters, characteristic diagrams are provided; and wherein the PDT1-filter has the following transmission function, $$\frac{Me_D(p)}{Me_W(p)} = k_M + \frac{(1-k_M)}{1+p*T_M} = \frac{1+p*T_M*k_M}{1+p*T_M}$$

wherein $k_M$ is the jump constant, $T_M$ is the time constant and p is the complex frequency variable.

15. Electronic bucking damping device for an internal-combustion engine with an electronic fuel injection, said electronic bucking damping device having a quantity request signal definable via an accelerator pedal and being fed to a fuel injection device, as well as a quantity component signal derived from bucking vibration superimposed on a rotational speed signal of the internal combustion engine and being supplied in an inverse-coupled manner to the fuel infection device, wherein said quantity request signal is present by way of a PDT1-filter at a summation point connected with a control signal input of the fuel injection device, and further wherein said rotational speed signal filtered by way of a separate D2T2-filter is present at this summation point as the quantity component signal to be subtracted; and wherein the D2T2-filter has the following transmission function, $$\frac{Me_R(p)}{N(p)} = \frac{p^2*k_R}{(1+p*T_R)^2}$$

wherein $k_R$ is the amplification factor, $T_R$ is the time constant, and p is the complex frequency variable.

16. Bucking damping device according to claim 15, wherein the fuel injection device is an electronically controlled injection pump.

17. Electronic bucking damping device for an internal-combustion engine with an electronic fuel injection, said electronic bucking damping device having a quantity request signal definable via an accelerator pedal and being fed to a fuel injection device, as well as a quantity component signal derived from bucking vibration superimposed on a rotational speed signal of the internal combustion engine and being supplied in an inverse-coupled manner to the fuel injection device, wherein said quantity request signal is present by way of a PDT1-filter at a summation point connected with a control signal input of the fuel injection device, and further wherein said rotational speed signal filtered by way of a separate D2T2-filter is present at this summation point as the quantity component signal to be subtracted;

wherein for defining at least a portion of the filter parameters for the filters, characteristic diagrams, are provided; and wherein the D2T2-filter has the following transmission function, $$\frac{Me_R(p)}{N(p)} = \frac{p^2*k_R}{(1+p*T_R)^2}$$

wherein $k_R$ is the amplification factor, $T_R$ is the time constant, and p is the complex frequency variable.

* * * * *